US008590085B1

(12) United States Patent
Smith

(10) Patent No.: US 8,590,085 B1
(45) Date of Patent: Nov. 26, 2013

(54) FLOATING, SELF-PROPELLING, SELF-BALLASTING PIVOTABLE BRIDGE

(76) Inventor: Shaun Smith, Boxford, MA (US)

( * ) Notice: Subject to any disclaimer, the term of this patent is extended or adjusted under 35 U.S.C. 154(b) by 0 days.

(21) Appl. No.: 13/562,632

(22) Filed: Jul. 31, 2012

(51) Int. Cl.
*E01D 15/04* (2006.01)

(52) U.S. Cl.
USPC ..... 14/32; 14/27; 14/28; 14/29; 14/30; 14/34; 14/35

(58) Field of Classification Search
USPC ..... 14/27–30, 32, 34, 35
See application file for complete search history.

(56) References Cited

U.S. PATENT DOCUMENTS

| | | | | | |
|---|---|---|---|---|---|
| 170,650 | A | * | 11/1875 | Vincent | 14/29 |
| 316,597 | A | * | 4/1885 | Barnett | 14/32 |
| 401,765 | A | * | 4/1889 | Stewart | 14/29 |
| 423,455 | A | * | 3/1890 | Steawart | 14/29 |
| 591,076 | A | * | 10/1897 | Gerdau | 254/93 R |
| 851,114 | A | * | 4/1907 | Biron | 14/32 |
| 1,158,084 | A | * | 10/1915 | Strauss | 14/32 |
| 3,499,179 | A | | 3/1970 | Weld | |
| 3,613,139 | A | | 10/1971 | Hansgen et al. | |
| 3,978,812 | A | | 9/1976 | Wagner | |
| 5,263,217 | A | | 11/1993 | Miglietti | |
| 5,495,631 | A | * | 3/1996 | Connor et al. | 14/2.6 |
| 6,167,582 | B1 | * | 1/2001 | Wiedeck | 14/2.6 |
| 6,536,063 | B1 | * | 3/2003 | Blase | 14/31 |
| 7,020,924 | B2 | * | 4/2006 | Cragg | 14/35 |
| 7,200,887 | B1 | * | 4/2007 | Powers | 14/27 |
| 8,382,539 | B2 | * | 2/2013 | Richeux et al. | 440/12.5 |
| 8,387,191 | B2 | * | 3/2013 | Honeycutt | 14/36 |
| 2003/0106172 | A1 | * | 6/2003 | Burke et al. | 14/31 |
| 2009/0038088 | A1 | * | 2/2009 | Adler et al. | 14/2.6 |

FOREIGN PATENT DOCUMENTS

| | | |
|---|---|---|
| WO | 2012/069825 | 5/2012 |

* cited by examiner

*Primary Examiner* — Raymond W Addie
(74) *Attorney, Agent, or Firm* — Borden Ladner Gervais LLP; Gail C. Silver

(57) ABSTRACT

A floating, self-propelling, self-ballasting, pivotable bridge system is described. The bridge has a main bridge body with a pontoon-like structure. One end of the bridge has a pivoting system comprising complementary pivot plates, one attached to the bridge and the other on land with a pivot pin attaching them at a pivot point. The other end of the bridge has a releasable locking mechanism. The bridge has ballast tanks for raising and lowering its level in the water. The bridge also has thrusters for propelling itself through the water when it pivots from a closed position spanning a waterway to an open position allowing boat traffic through a waterway.

19 Claims, 7 Drawing Sheets

FLOATING, SELF-PROPELLING, SELF-BALLASTING PIVOTABLE BRIDGE

FIELD

The present disclosure relates generally to swing bridges for spanning waterways and in particular floating, self-propelling, self-ballasting, pivotable bridges.

BACKGROUND

There are many instances where it is necessary or desirable to provide a road or walkway across a waterway to allow vehicle and pedestrian access but which also requires that the bridge be movable to allow boat traffic through the waterway. Existing movable bridges including bridges that are raised upward, either by raising the entire span of the bridge vertically by hydraulics or counterweights to allow boat traffic to pass below the bridge or splitting the bridge in its midsection (bascule bridge) and raising the outer end of each piece of the bridge span to allow boat traffic to pass underneath through the waterway. Other examples of movable bridges include those that rotate on a platform or central piece to allow the bridge to swing out of at least part of the waterway. These bridges are permanent structures and require extensive construction and high cost to install, maintain and operate them. Disadvantages of such bridges are that the extent of bridge movement may be limited so that the height or size of boat traffic may be limited, and they are often extremely expensive to build. Further, many of these bridges still have some bridge structure over the waterway and pose a potential danger to larger ships that may pass through.

Less expensive, temporary bridges may be used for less travelled waterways. One temporary bridge is described in U.S. Pat. No. 3,499,179. This bridge has a plurality of connected sections which are quickly and easily connected together to form the bridge. The bridge may be disassembled and has carrying handles for the plurality of sections. The sections may also be connected to form a raft. It may have pontoons or floats to increase its buoyancy. Further, outboard motors may be attached to propel the raft. However, this bridge/raft is a temporary structure and not suitable as a permanent bridge attached to land which allows vehicle and pedestrian traffic on a long term basis. Further, although the raft may have motors to propel it, the propellers are not meant to move the bridge in and out of position across the waterway, alternating the passage of vehicle traffic over the raft and the passage of boat traffic through the waterway. The raft has no convenient means to propel it between its two positions and would require extensive maneuvering and time to do so.

U.S. Pat. No. 5,263,217 describes a swing bridge for spanning waterways. The bridge is permanently attached at one end to land and removable attached at its other end when spanning the waterway. At its permanently attached end, it is connected by a hinge pivot. The hinge pivot allows the bridge to pivot between its closed position spanning the waterway and an open position where boat traffic can pass through the waterway. The bridge also includes a propeller or jet-type motor which acts transversely to the bridge to advance it between its open and closed positions. The end 21 of this bridge rests in a seat 13. When the bridge is to be moved to an open position to allow boat traffic to pass through the waterway, the length of the bridge is lifted to raise the end 21 out of its seat 13. This requires extensive adjustment of the hollow floating bodies and trim of the bridge. The pivot mechanism for this bridge uses a plurality of wheels 16 on shafts. The idle wheels rest on a base 11 and provide support for the end of the bridge. The pivot system restricts the "pitch" of the bridge. If the bridge pitches during movement, this movement may cause a breakdown of the pivot system. Further, the idle wheels and shafts are subject to considerable forces during pivoting of the bridge and may not be sufficient to withstand these forces in repeated bridge movement. This bridge system could not be used to span large waterways since it could not withstand the stresses involved during the vertical pivot, i.e. when the length of the bridge is lifted from its seat 13, and the structure would fracture or break during the raising of the bridge. It appears that this bridge could only be used to span distances of no more than 100 feet. A more robust bridge system is desirable.

SUMMARY

It is an object of the present disclosure to obviate or mitigate at least one disadvantage of previous bridges.

In a first aspect, the bridge system is a pivotable bridge system for spanning at least a portion of a waterway having a first embankment and a second embankment. The system has a main bridge body having a first end and a second end. The main bridge body has a roadway on its upper surface for allowing vehicle and/or pedestrian traffic to pass over it. The bridge system also has a locking mechanism at the first end of the main bridge body for connecting with a first complementary locking mechanism at the first embankment, for removably locking the first end of the bridge in a closed position spanning at least a portion of a waterway. The bridge system also has a pivoting system at the second end of the main bridge body. The pivoting system has one or more plates attached to the second end of the bridge for attaching to complementary plates at the second embankment thereby forming a pair of plates. Each pair of plates has a pivot point, wherein if more than one pair of plates are present, the pivot point in each of the pairs of plates align. The pivoting system also has a locking pin for insertion into the pivot point in each pair of plates for pivotally connecting the pair of complementary plates. The bridge pivots from a closed position spanning at least a portion of the waterway for allowing vehicle and/or pedestrian traffic to cross the roadway, to an open position for allowing boat traffic through the waterway.

In a further embodiment, the bridge system has a self-ballasting system for raising or lowering the level of the main bridge body in the water for allowing the bridge to adjust to the height of the water to maintain the roadway level with the road at the embankments. The pivoting system may also allow the complementary pivot plates at the second embankment to raise and lower for adjusting with the height of the water and/or main bridge body.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Generally, one aspect of the present disclosure describes a floating, self-propelling, self-ballasting, pivoting bridge for providing ground traffic access across a waterway when in a closed position and allowing boat traffic when in an open position.

Figure 1:
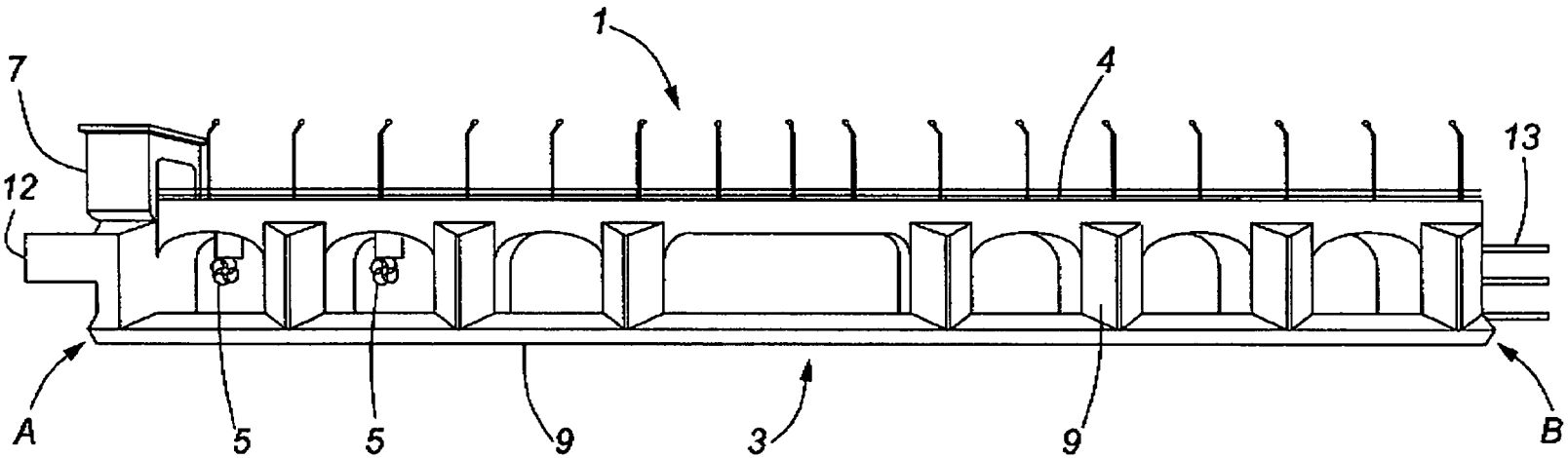
FIG. 1 is a side view of one aspect of the bridge.

Referring to the figures, the floating, self-propelling, self-ballasting, pivoting bridge system 1 is shown in FIG. 1. In a closed position, the bridge extends across a waterway and provides vehicle and pedestrian access across its upper surface. The bridge may also swing to an open position where it is generally parallel to shore and no longer allows vehicle and pedestrian access across its surface but instead, allows boat traffic to pass through the waterway.

The bridge has a main floating body 3 with an upper roadway surface for allowing vehicle and pedestrian traffic to pass over the bridge. The bridge is connected to land at each end A and B. End A has a locking system which can be disengaged. End B has a pivot system which allows the bridge to pivot about end B when end A is unlocked and disengaged. The bridge has a self-propulsion system 5. This allows the bridge to move between an open position where the bridge is positioned generally parallel to shore and a closed position where the bridge is spanning the waterway. The bridge may have a wheelhouse 7 for an operator. The bridge may also have ballast tanks 9 to allow the bridge to float and for adjusting the level of the bridge in the water.

The upper surface of the bridge includes a road surface 4. The road surface shown in the figures is constructed of a metal grid system although any conventional system could be used.

The main body of the bridge has a general pontoon-like structure. It has a number of openings under the roadway with a general arched-shape structure and a bottom portion connecting each arched-shaped structure along the bottom length of the bridge. When the bridge is in water, the bottom portion is underwater and water is able to pass through these openings. Water current will therefore have less effect on the bridge than if it had a solid hull design. The pontoon-like edges on each side of the bridge may also have a wedged-shaped structure and the bottom portion may also be wedged-shaped on both sides of the bridge, with the edge of the wedge extending outward towards the water. The overall pontoon-like structure and/or with wedged-shape edges would allow the bridge to move through the water with less resistance. This allows the bridge to move more quickly between its open and closed positions.

Figure 3:
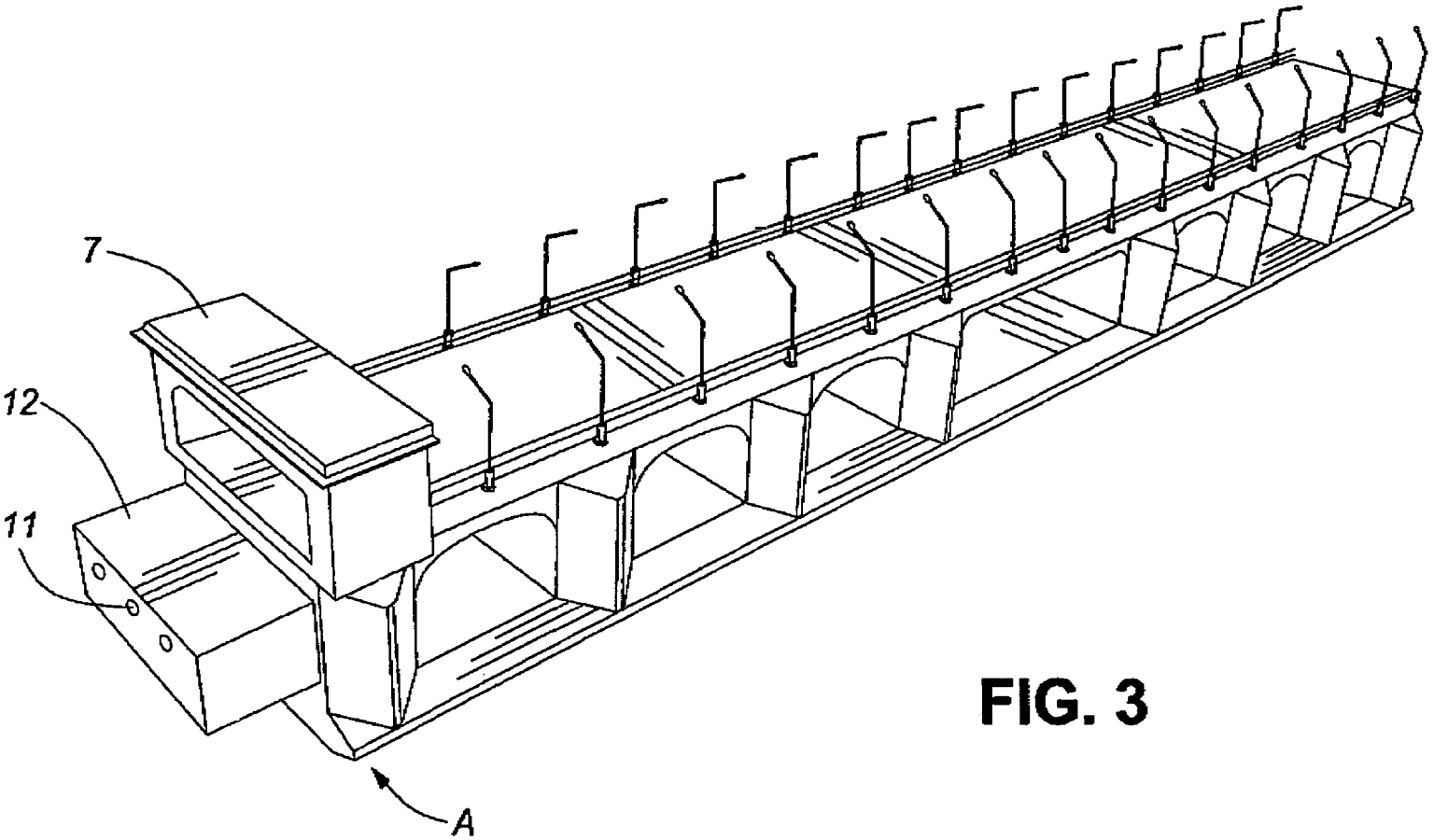
FIG. 3 is a side perspective view of the bridge showing parts of the locking system.

The bridge is connected to land at each end shown as A and B. At end A, the bridge has a housing and locking system for connecting to a complementary system on land. End A may be locked to the complementary system on land so that the bridge is locked into a closed position, spanning the waterway. End A may be disconnected from the complementary system on land so that the bridge is able to swing into an open position, where the bridge is positioned generally parallel to the shore, allowing boat traffic to pass through the waterway. Any conventional locking mechanism may be used. One such mechanism is a hydraulic ram system used to connect tug/barge systems. These types of systems use a type of hydraulic ram or "teeth and cog" locking arrangements. Examples of tug/barge locking systems which may be altered for the present use include Artubar™, Articouple™, Intercon™, Bludworth-Cook System™, Hydraconn™, and Beacon Jak™ locking systems. In FIG. 3, locking ram ports 11 are provided at end A in a housing 12 for a hydraulic ram system. The ram ports 11 receive locking rams installed on the adjacent land. When the locking rams are inserted into the ram ports, the bridge is locked in place in a closed position, spanning the waterway, and there is no vertical or lateral movement to the bridge structure. Vehicle and pedestrian traffic can now safely pass over the upper surface of the bridge. In addition, the same locking system may be used to lock the end A when it is in an open position generally parallel to store by providing a second complementary system mounted adjacent end A at its open position shown in FIG. 7.

Figure 2:
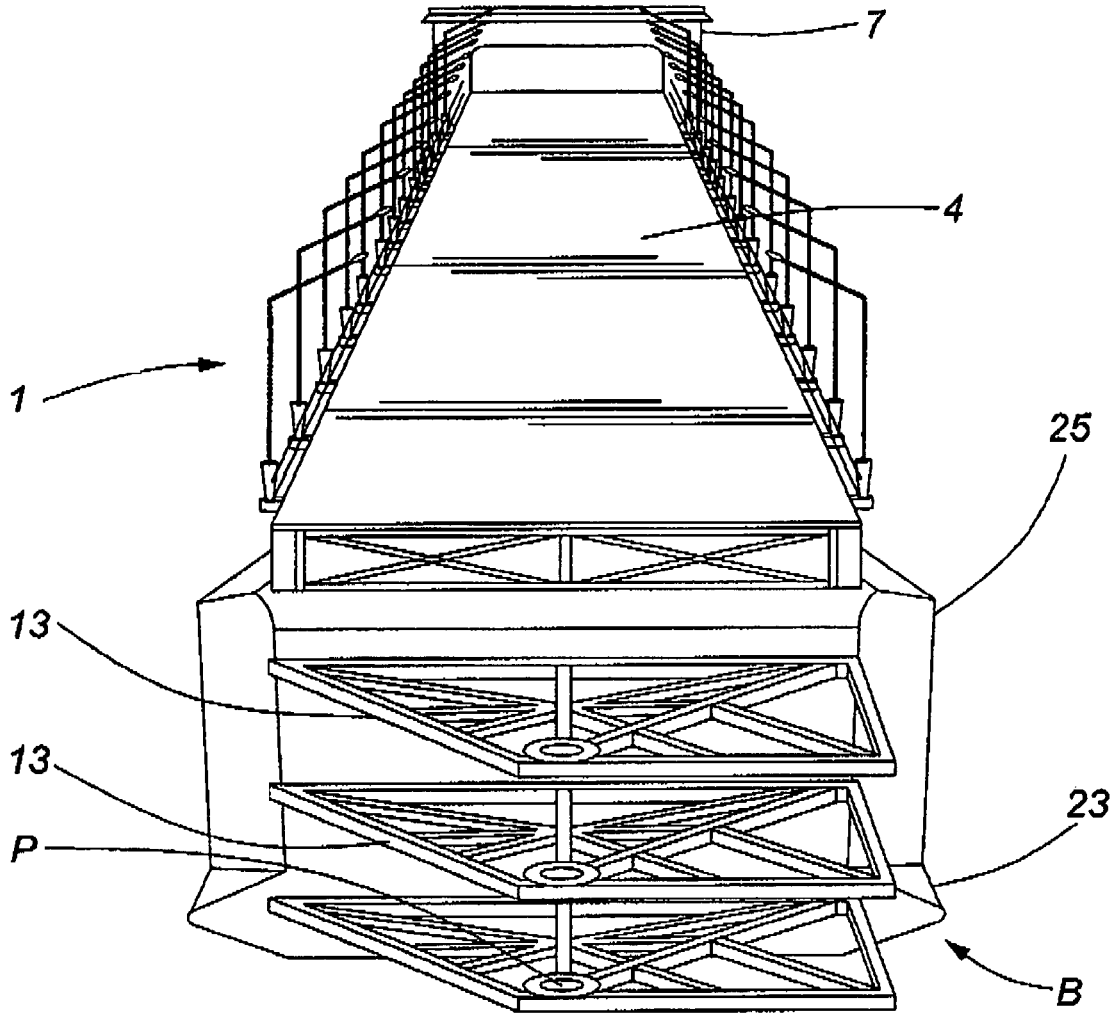
FIG. 2 is an end view of the bridge showing the pivot system.
Figure 5:
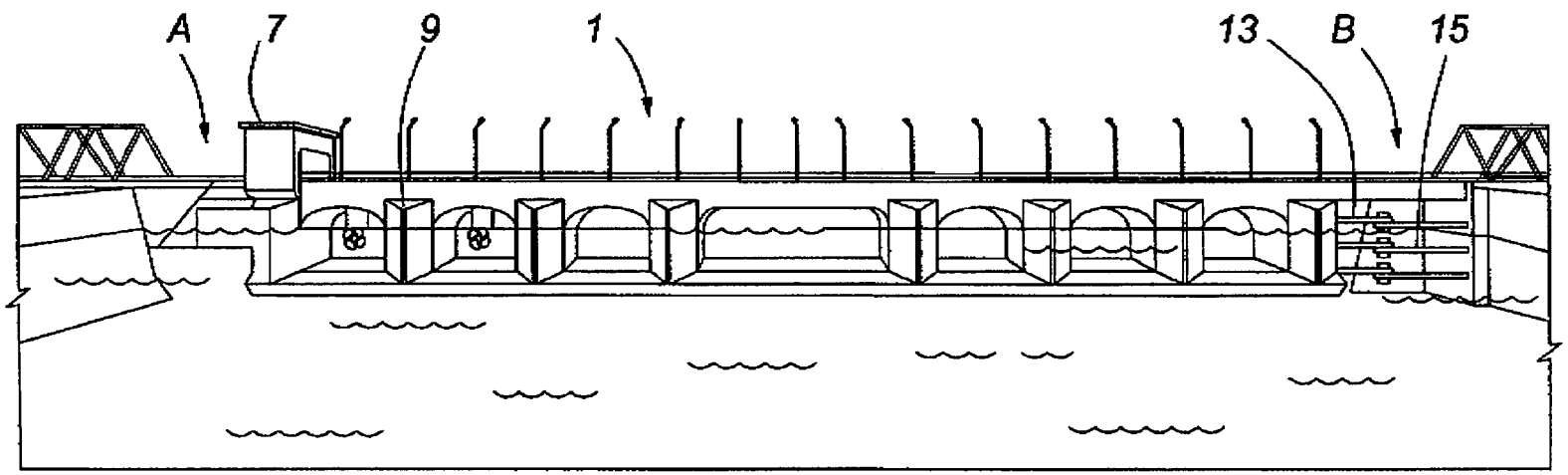
FIG. 5 is a side view of the bridge showing it positioned across a waterway in a closed position.
Figure 6:
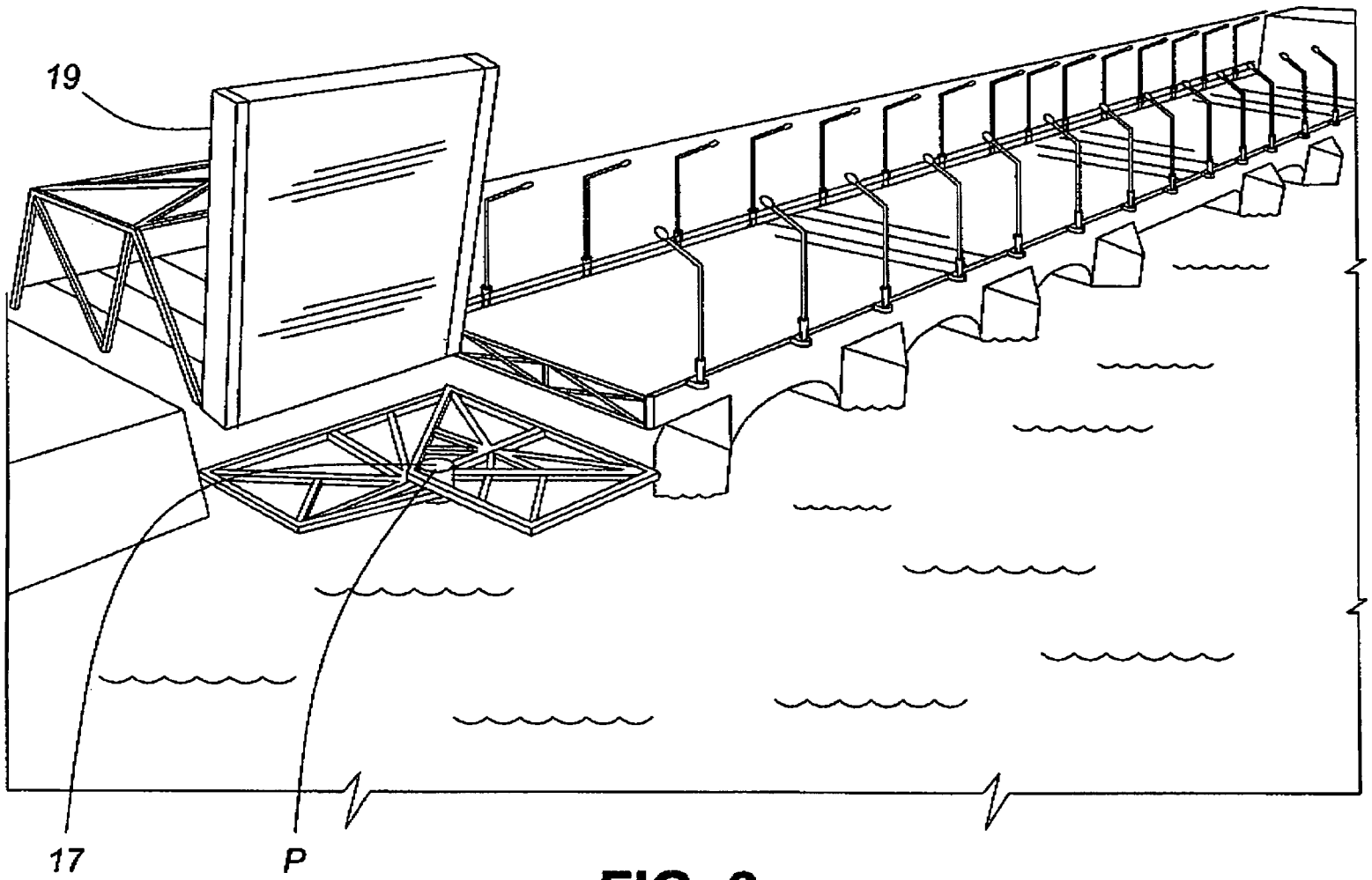
FIG. 6 is a view of the bridge in an open position, generally parallel to shore, with the hinged roadway portion raised to show the pivot system.

At end B, the bridge has a pivot system shown in more detail in FIGS. 2, 5 and 6. End B is permanently fastened to its complementary system on land using a pivot system that allows the bridge to pivot about end B when moving from its closed position, spanning the waterway, to its open position, adjacent the shore. The end B has three pivot plates 13 connected to the bridge, each with a pivot point P. On shore are complementary pivot plates 15 having pivot points which align with the pivot points on the bridge plates at end B. A locking pin 17 is inserted through the pivot points in each pair of complementary pivot plates, thereby connecting the bridge to the shore but allowing the bridge to pivot about the pivot point P. Although 3 pivot plates and 3 locking pins are shown in the figures, any suitable number of plates and pins may be used. The locking pin will allow the bridge structure a small vertical movement up and down on the pivot system. This will ensure that strong vertical forces are not exerted on the pivot system during changes in the water level when the bridge is either taking on board or releasing water ballast.

The bridge may also include a locking gate stabilizer arm. Any conventional locking gate stabilizer arm may be used. This arm may be a pivotable and/or extendable arm that extends from a mounted position on land or another fixed structure to a point on one side of the bridge, near end B. The bridge system may also include stabilizer arms located below the water surface that would connect to the submerged corners of the bridge at end B. As the bridge moves between its open and closed positions, the lock gate stabilizer arm(s) will move accordingly, extending or shortening and/or pivoting from its fixed end, with the movement of the bridge. This arm(s) provides additional support for the bridge during its movement between its open and closed positions.

At end B, the pivot plates 15 may be mounted on a system which allows vertical movement of the pivot plates to allow the plates to be vertically raised or lowered with the change in height of the water. The mount could be any conventional mount. Examples include the use of a large kingpin where the plates would ride up or down on the kingpin with the change in water height or the pivot plates could be fixed into vertical steel channels where the pivot plates would be raised or lowered in these channels depending on the water level.

The system also includes a hinged roadway system 19, also known as a linkspan or drawbridge, above the pivot plates. This is shown in FIG. 6. In the figure, the hinged roadway system 19 is installed on land above the pivot plates 13, 15. However, it may alternatively be installed on the bridge. The hinged roadway system 19 moves to a raised, upper position, shown in FIG. 6, to allow the bridge to swing to an open position generally parallel to shore. When the bridge is repositioned across the waterway and locked at end A in a closed position, the hinge roadway system 19 is lowered to a horizontal position, as shown in FIG. 5, to allow vehicle and pedestrian traffic to cross the roadway on the upper surface of the bridge. The hinged roadway system is shown in the figures at end B but could also be included at end A.

Figure 4:
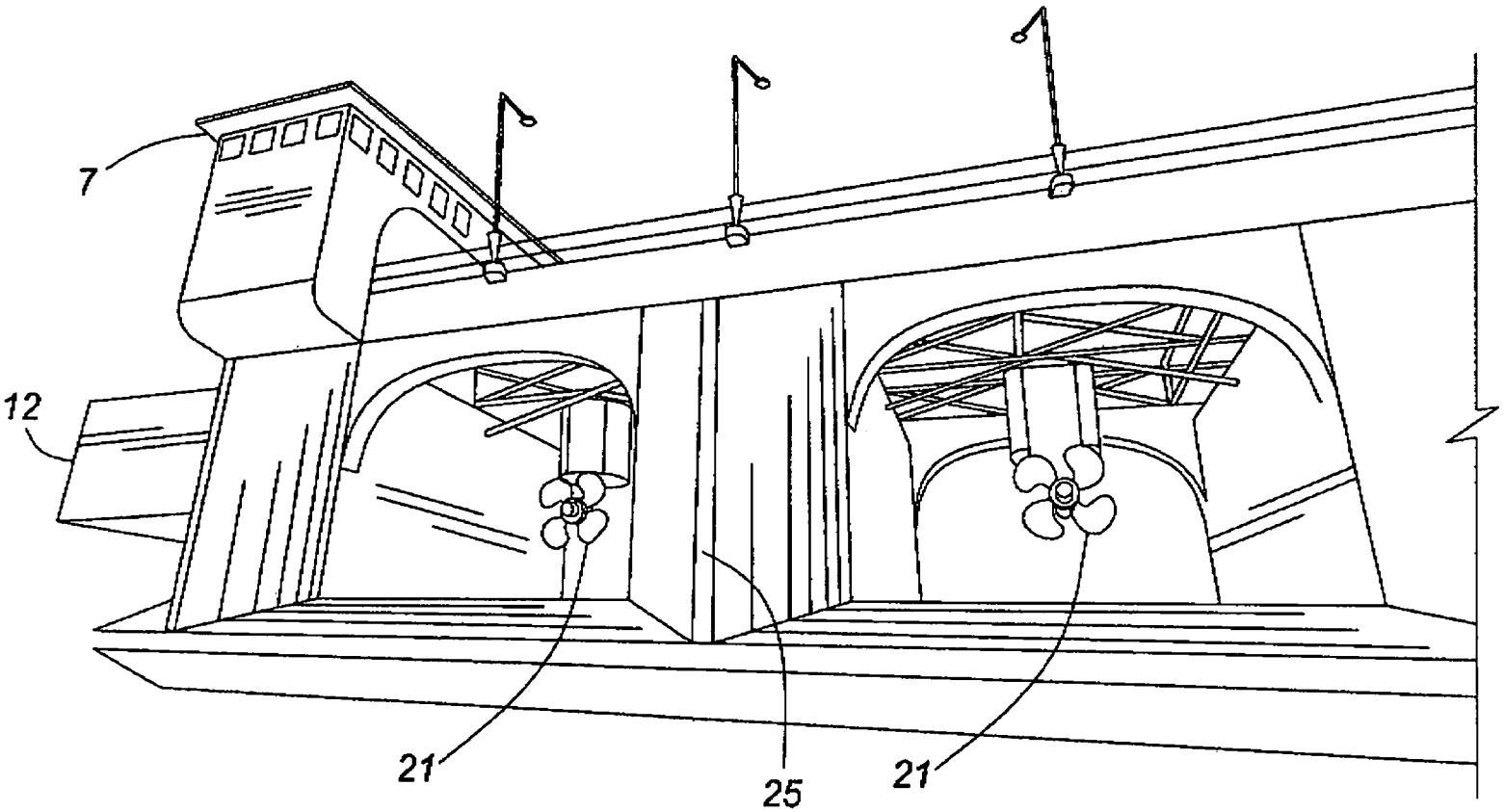
FIG. 4 is a side perspective view of one end of the bridge, showing the self propulsion system.

The bridge is self propelled to move from its closed position spanning the waterway to an open position generally parallel to shore. One aspect of the self propulsion system is shown in more detail in FIG. 4. The system in FIG. 4 uses thrusters 21 installed under the bridge near swinging end A. FIG. 4 shows two thrusters but any number of thrusters may be used. In one aspect, the thrusters are azimuth thrusters. Azimuth thrusters can be rotated in any horizontal direction and provide improved maneuverability over a fixed propeller system. In one aspect, the thrusters are electrically powered, with the power supplied from the pivot end B of the bridge. In one aspect, the thrusters are operated from the wheelhouse. From a closed position, after disengaging the locking system at end A, the thrusters are activated and propel the bridge through the "swing" to its open position. Full thrust is continued until the bridge reaches about 40 degrees through the 90 degree swing. At this point, the thrusters are redirected in the opposite direction to slow the swing. Once the bridge is stopped and in position, the locking system at end A may secure the bridge in position. The entire operation may be done manually or by computer program with manual override.

The bridge may need to adjust its height during different seasons or tides so that the roadway of the bridge is at the same height as the roadway on land. In one aspect, the raising and lowering of the bridge may be done by a ballast system. Any conventional ballast system may be used. The ballast system would be of sufficient size to provide the ballast/tank capacity to provide sufficient buoyancy and stability to support the structure and allow the structure to ride lower in the water during high water and ride higher in the water during low water. In the figures, the ballast system is provided within the pontoon structure and includes ballast tanks 9. These may be vertical tanks on the side of the bridge and/or tanks on the bottom of the bridge. FIG. 4 shows one aspect of a ballast system including a common double bottom ballast tank 23 running the length of the bridge connected to a number of vertical side ballast tanks 25. Alternatively, the ballast tanks may be divided into separate tanks and may be double skinned for safety purposes. In one aspect, the ballast tanks shown in the figures have a wedge structure that offers less resistance to the water during swinging of the bridge. The ballast tanks would be equipped with ballast pumps and emergency backup ballast pumps, as required. The ballast tanks can be filled or emptied of water to lower or raise the bridge position as necessary. FIG. 5 shows the bridge positioned lower in the water in a "ballasted down" position. The ballast system may be operated from the wheelhouse. It can be done manually or by using a computer automated system. It may also use a laser system for optimum alignment. When the ballast system adjusts the height of the bridge, the pivot system would be adjusted accordingly at end B.

Figure 7:
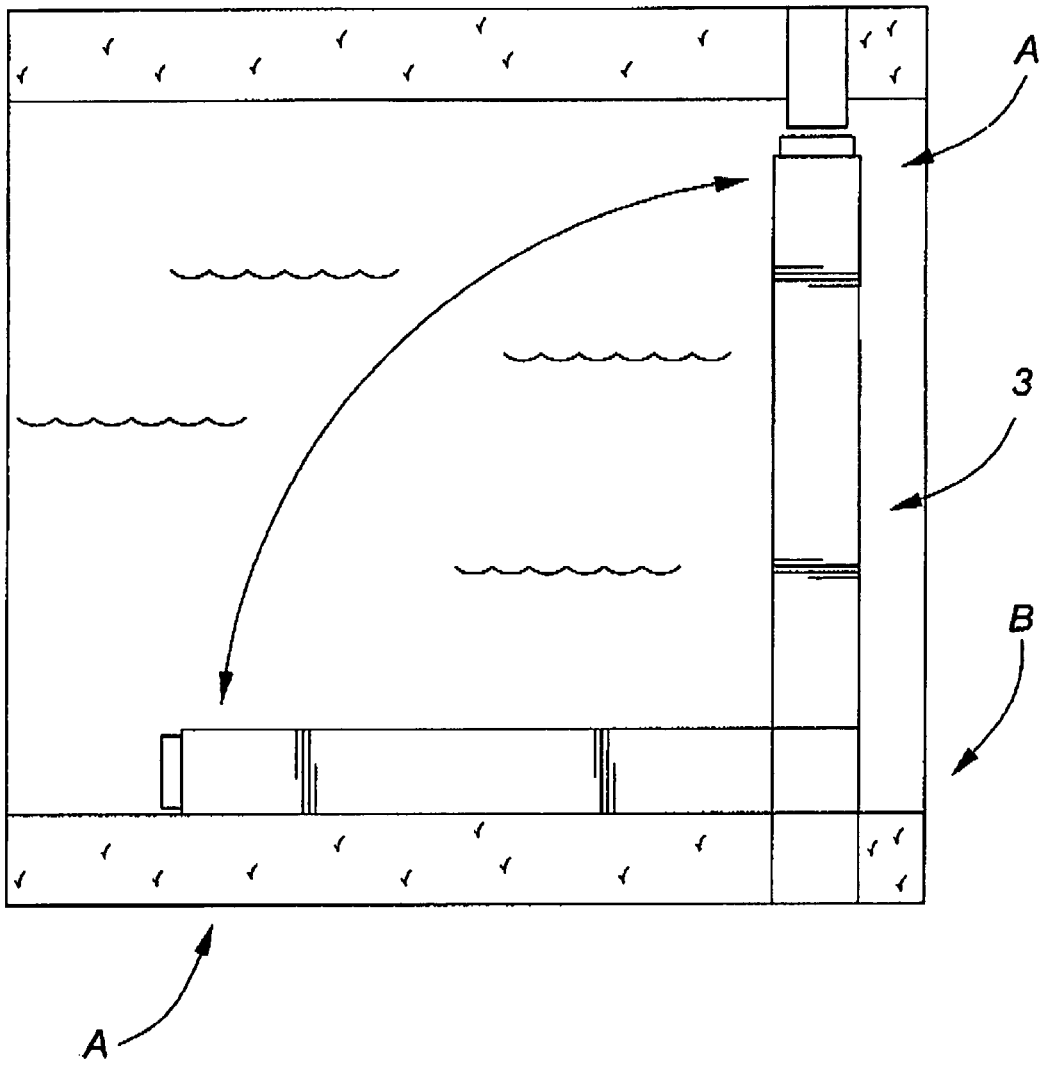
FIG. 7 is a top view of the bridge showing it in an open and a closed position.

FIG. 5 shows the bridge in a closed position spanning the waterway. In this position, the locking ram system at end A is locked to a complementary system on land. The pivot plates 13 and 15 are engaged by locking pins 17. The hinged roadway system is lowered. Vehicle and pedestrian traffic can cross the upper surface of the bridge. FIG. 6 shows the bridge in an open position. The end A is disengaged from the locking ram system. The hinged roadway system is lifted. The thrusters have moved the bridge about pivot point P until the bridge is generally parallel to shore in its open position. The movement of the bridge between its open and closed positions is shown in FIG. 7.

In one aspect, the bridge is operated from the wheelhouse.

One benefit of this bridge system is that it can span passages of water in canals, waterways or river systems. In one design, the bridge is 450 feet long and 62 feet wide. It can be used to span narrow bodies of water or it may form an opening link for vessel navigation in a longer bridge system such as an opening link of a multi-pontoon bridge system or an opening link in a fixed/permanent bridge structure.

In the preceding description, for purposes of explanation, numerous details are set forth in order to provide an understanding of the embodiments. However, it will be apparent to one skilled in the art that these specific details are not required.

The above-described embodiments are intended to be examples only. Alterations, modifications and variations can be effected to the particular embodiments by those of skill in the art without departing from the scope, which is defined solely by the claims appended hereto.

What is claimed is:

1. A pivotable bridge system for spanning at least a portion of a waterway having a first embankment and a second embankment, the system comprising:

a main bridge body having a first end and a second end, the main bridge body having a roadway on its upper surface for allowing vehicle and/or pedestrian traffic to pass over the main bridge body;

a locking mechanism at the first end of the main bridge body for connecting with a first complementary locking mechanism at the first embankment, for removably locking the first end of the bridge in a closed position spanning at least a portion of a waterway;

a pivoting system at the second end of the main bridge body, the pivoting system comprising:

one or more substantially horizontal plates attached to the second end of the bridge for attaching to complementary plates at the second embankment thereby forming a pair of plates, each pair of plates having a pivot point, wherein if more than one pair of plates are present, the pivot point in each of the pairs of plates align;

a locking pin for insertion into the pivot point in each pair of plates for pivotally connecting the pair of complementary plates; and a self-propulsion system for engaging water in the waterway for moving the main bridge body between a closed position spanning at least a portion of the waterway and an open position allowing traffic through the waterway;

wherein the bridge pivots from a closed position spanning the at least a portion of the waterway for allowing vehicle and/or pedestrian traffic to cross the roadway, to an open position for allowing boat traffic through the waterway.

2. The pivotable bridge system of claim 1 further comprising means for raising or lowering the height of the complementary pivot plates at the second embankment for allowing the bridge to adjust with the height of the water.

3. The pivotable bridge system of claim 1, wherein the main bridge body has a pontoon structure, wherein the body comprises an upper section including the upper roadway, a base section generally parallel to the upper section, and one or more vertically extending portions extending from the upper section of the bridge to the base section, wherein water passes between the vertically extending portions in the main bridge body.

4. The pivotable bridge system of claim 1 wherein the main bridge body further comprises ballast tanks for raising or lowering the level of the bridge in the water.

5. The pivotable bridge system of claim 4 wherein the ballast tanks include one or more vertical ballast tanks on the sides of the main bridge body and/or one or more bottom ballast tanks along the lower edge of the main bridge body.

6. The pivotable bridge system of claim 4 wherein the ballast tanks include one or more vertical ballast tanks on the sides of the main bridge body and one or more bottom ballast tanks along the lower edge of the main body where the ballast tanks are interconnected.

7. The pivotable bridge system of claim 3 wherein one or more of the vertically extending portions of the main bridge body each include a ballast tank and/or the base section includes a ballast tank.

8. The pivotable bridge system of claim 1 further comprising a hinged roadway portion at the second end of the main bridge body for allowing vehicle and pedestrian traffic to pass over the pivoting system when the bridge is in a closed position, wherein the hinged roadway portion is raised before the bridge is moved to an open position.

9. The pivotable bridge system of claim 1 further comprising a second hinged roadway portion at the first end of the main bridge body.

10. The pivotable bridge system of claim 1 wherein the locking mechanism at the first end is a locking ram mechanism.

11. The pivotable bridge system of claim 1 further comprising a second complementary locking mechanism for connecting with the locking mechanism at the first end of the main bridge body for locking the first end of the main bridge body in the open position.

12. The pivotable bridge system of claim 1 wherein the self-propulsion system includes one or more thrusters positioned at or near the first end of the main bridge body.

13. The pivotable bridge system of claim 12 wherein the thrusters comprise azimuth thrusters.

14. The pivotable bridge system of claim 12 wherein the thrusters comprise two azimuth thrusters near the first end of the main bridge body.

15. The pivotable bridge system of claim 1 wherein the main bridge body spans across a waterway.

16. The pivotable bridge system of claim 1 wherein the main bridge body spans a portion of a waterway and is connected to one or more other bridges.

17. The pivotable bridge system of claim 1 further comprising a locking gate stabilizer arm comprising an arm extending from a position at or near the first or second embankment to a point on the bridge, the arm capable of extending and retracting, for helping to stabilize the bridge while the bridge moves between the open and closed positions.

18. The pivotable bridge system of claim 1 further comprising a wheel house for operation of the bridge system.

19. A method of moving a floating, self propelling, self-ballasting pivotable bridge between a closed position spanning at least a portion of a waterway to an open position allowing boat traffic to pass through the waterway, the bridge having a main body and a roadway across the main body for allowing vehicle and pedestrian traffic to pass over the bridge when in a closed position, wherein the waterway has a first and second embankment, comprising the steps of:

a) disengaging a locking mechanism at a first end of the main body from a complementary locking mechanism at the first embankment;

b) engaging a propulsion system at the first end of the main body for moving the first end of the main body towards shore, wherein the main body pivots at the second end, the second end having a pivoting system with one or more plates attached to the second end of the bridge for attaching to complementary plates at the second embankment thereby forming a pair of plates, each pair of plates having a pivot point, wherein if more than one pair of plates are present, the pivot point in each of the pairs of plates align, and a locking pin for insertion into the pivot point in each pair of plates for pivotally connecting the pair of complementary plates; and c) engaging alternate propulsion system or reversing engagement of the propulsion system for slowing the movement of the main body and/or stopping the main body in its open position; wherein boat traffic can pass through the waterway; and d) optionally adjusting the height of the bridge for the roadway to maintain an operable height to the embankment.

* * * * *